US007121918B2

(12) United States Patent
Marti et al.

(10) Patent No.: US 7,121,918 B2
(45) Date of Patent: Oct. 17, 2006

(54) MACHINE TOOL AND METHOD FOR PROCESSING WORKPIECES USING A WATER JET

(75) Inventors: Daniel Marti, Ammerzwil (CH); Marcel Kolb, Küttigen (CH); Stefan Sanson, Zug (CH)

(73) Assignee: Bystronic Laser AG, Niederonz (CH)

( * ) Notice: Subject to any disclaimer, the term of this patent is extended or adjusted under 35 U.S.C. 154(b) by 298 days.

(21) Appl. No.: 10/830,417

(22) Filed: Apr. 22, 2004

(65) Prior Publication Data

US 2005/0079797 A1 Apr. 14, 2005

(30) Foreign Application Priority Data

Oct. 9, 2003 (EP) ..... 03405724

(51) Int. Cl.
*B24B 51/00* (2006.01)

(52) U.S. Cl. ..... 451/2; 451/36; 451/75

(58) Field of Classification Search ..... 451/2, 451/5, 11, 36, 38, 54, 75, 89
See application file for complete search history.

(56) References Cited

U.S. PATENT DOCUMENTS

| | | | | |
|---|---|---|---|---|
| 4,949,610 | A | 8/1990 | Jones et al. | |
| 5,782,673 | A | 7/1998 | Warehime | |
| 6,299,510 | B1 * | 10/2001 | Massenburg | 451/38 |
| 6,379,214 | B1 * | 4/2002 | Stewart et al. | 451/2 |
| 6,663,465 | B1 * | 12/2003 | Gross | 451/5 |

FOREIGN PATENT DOCUMENTS

EP 0 983 827 3/2000

OTHER PUBLICATIONS

BYJET brochure, "Abrasiv-Wasserstrahlschneiden—die ideale Erganzung zum Schneiden verschiedenster Materialien," of Bystronic Laser AG, CH-3362 Niederonz, Swtizerland; 6 pages, available in German language only (undated).
BYJET internet brochure, "Byjet—The flexible waterjet cutting system for demanding applications, Expertise in Waterjet Cutting," of Bystronic at www.bystronic.com: 8 pages, English (undated).

* cited by examiner

*Primary Examiner*—Jacob K. Ackun, Jr.
(74) *Attorney, Agent, or Firm*—Weingarten, Schurgin, Gagnebin & Lebovici LLP

(57) ABSTRACT

During the processing of workpieces using a water jet, standstill times or even operating interruptions arise on the machine tools when the processed workpieces are removed and the workpieces to be processed are positioned on the machine. This is made more difficult above all in water-abrasive jet cutting, which is known to be performed on immersed workpieces. Through a water basin, which may be flooded in a simple way and has a foldable side wall having lift-pivot cylinders on its front side, supports may be pushed into and out of the water basin. A loading station, having lifting devices, positioned behind the machine tool allows the preparation of workpieces while the machine tool executes a jet processing. The loading station having a linear drive allows the stacking of prepared supports. According to the method, the flooding of the water basin and the control of the foldable side wall are tailored to the loading station, through which a performance increase of the machine tool arises.

13 Claims, 6 Drawing Sheets

48
49
10
42'
42
37
46
47
45
43
2'
WO
2
17
62
61
21
60

MACHINE TOOL AND METHOD FOR PROCESSING WORKPIECES USING A WATER JET

This application claims priority to a European application No. 03 405724.0 filed Oct. 9, 2003.

FIELD OF THE INVENTION

The present invention relates to a machine tool for processing workpieces using a high-pressure water jet and a method for operating a machine tool for processing workpieces using a high-pressure water jet.

BACKGROUND OF THE INVENTION

CNC machines using high-pressure water jet processing, particularly water jet cutting systems having one or more nozzles, are generally known. Thus, for example, a brochure (BYJET, undated) of the firm Bystronic Laser AG, CH-3362 Niederönz shows a universal cutting facility, suitable for pure water jet cutting and for abrasive jet cutting. A CNC-controlled cutting carriage movable over a water basin carries one or more cutting heads which are fed by high-pressure pumps having up to 4000 bar nominal output. Depending on the cutting agent (pure water jet or abrasive-water jet) the cutting is performed over the water surface or under the water surface. For this purpose, equalizing containers are provided which allow level regulation of the water bed and particularly function during loading and unloading of the cutting grate or grid.

This known machine has the disadvantage above all that during the loading and unloading, significant standstill times arise, which massively impair the overall output of the system.

Water jet processing is also increasingly used in mass production, and it has advantages in relation to laser processing, but in contrast thereto, no changes in the microstructure arise at the processing point. In addition, diverse materials, such as plastics and natural materials, foods, etc., can bear no or only a slight thermal stress, so that some advantages, such as performance and precision in laser processing, often do not come into consideration.

SUMMARY OF THE INVENTION

Is therefore the object of the present invention to provide a universal machine tool for water jet processing which allows a performance increase in relation to the machines used until now. In this case, reducing the standstill times of the machine is of special significance. The machine tool is not to take up any additional space in spite of easier charging and simplified unloading, i.e., the space provided for the preparation of loading and unloading is to be usable and easily accessible. The workpieces to be processed are to be positionable using existing and/or commercially available supply stations and the processed parts are to be transportable in the simplest way and/or be available directly for use.

This object is achieved by a machine tool for processing workpieces using a high-pressure water jet, the workpiece to be processed being mounted on a grate-like or grid-like support over or in a water basin, which is cuboid at least in the upper region, and has at least one water jet exiting from at least one nozzle applied to it. This nozzle is numerically controlled in its position at least in a horizontal plane (X, Y) and the distance between the workpiece and the nozzle is kept at least approximately constant or controlled in the vertical direction (Z) and an equalization container is provided in the region of the water basin, via which the level in the water basin is set. At least one side wall on the water basin is designed as partially raisable or foldable, and sliding elements, which allow a frame, having workpieces (W0, W1) positioned on its workpiece supports, to be moved in and out, are positioned on at least the fixed side walls adjoining this side wall.

The corresponding method for operating a machine tool for processing workpieces uses a high-pressure water jet, the workpiece to be processed being mounted on a grate-like or grid-like support over or in a water basin, which is cuboid at least in the upper region, and having at least one water jet exiting from at least one nozzle applied to it. This nozzle has its position numerically controlled at least in a horizontal plane (X, Y) and the distance between the workpiece and the nozzle is kept at least approximately constant or controlled in the vertical direction (Z), and an equalization container is provided in the region of the water basin, via which the level in the water basin is set. In a first method step, the water basin is filled to a lower level (N2). In a second step, with the side flap opened, a frame equipped with workpieces is introduced horizontally. In a third step, the flap is closed tight and the water is let into the water basin until a higher level (N1) results. In a fourth step, the water jet processing is performed. In a fifth step, the water is let out to the lower level (N2) and subsequently the flap is opened until it is in the horizontal setting. In a sixth step, the frame is moved horizontally out of the water basin. In a seventh step, a further frame equipped with workpieces is introduced horizontally into the water basin and the flap is closed tight again.

The raisable or foldable side wall of the present invention is advantageously a front wall having a closable rectangular opening (bulkhead). This opening is dimensioned in such a way that a frame having workpiece supports and workpieces located thereon may be pushed into and out of the water basin without problems manually or through a linear drive known per se.

In this way, completely processed batches (processing units) may be removed and unprocessed batches may be loaded back into the machine in less than two minutes. The standstill times of the machine tool are therefore multiple times shorter than, for example, with loading and unloading on location or if a hoist is used to raise and lower the frame in the water basin. A further advantage is the small space required for the whole and the accessibility during the charging and positioning of the workpieces.

The preparation work on the workpieces, such as placement and adjustment on the supports, is shifted out of the actual machine and may be performed conveniently, accessible from all the workpiece in the Z direction or are also CNC-controlled. sides, on a loading station, also known as a shuttle table.

The operating method according to the present invention is distinguished by its simple and easy-to-control sequence. It originates from a water jet processing machine known per se, whose cutting heads are controllable horizontally in the X, Y direction and either maintain a constant distance to the workpiece in the Z direction or are also CNC-controlled.

Preferred refinements of the object of the present invention are described further below.

Further frames having supports allow "bunkering" of prepared batches in a quantity which is arbitrary per se. Only a lifting device is provided for moving the frames in and out, which receives the frames having the particular processed parts at the correct height and/or provides the frames having unprocessed workpieces.

An equalizing container, which communicates with the water basin and may have a compressed air source applied to it, is mounted in or below the water basin and allows a space-saving arrangement for setting the water level in the basin.

The compressed air source may be a side channel compressor, which is especially advantageous for setting the water level, but its volume flow and pressure curve are ideally suited for driving water out of the equalizing container and therefore for setting the higher level in the water basin.

The attachment of a cleaning station that contains water nozzles and/or compressed air nozzles above the openable side wall is very efficient, since the processed parts may thus be washed and/or dried. This is especially advantageous in the case of abrasive processing procedures, since the processed parts are known to be contaminated with solid particles (garnet sand: $Fe_3Al_2(SiO_4)_3$; olivine: $(Mg,Fe)_2[SiO_4]$). The cleaning station allows their direct use and/or their packing without further cleaning procedures.

The use of the compressed air source used for setting the higher water level for blowing off and drying the processed parts is very economical, but this source is not used when the side wall is open, so that the air jet generated there may be conducted to compressed air nozzles connected to the compressed air source connected to the equalization container.

Besides numerous possibilities for pushing the frames having supports and workpieces in and out through linear drives, the use of a chain drive has especially proven itself. This drive is space-saving and may perform the necessary forward and backward movement on the frame economically via simple tappets.

The "driving out" of the water from an intermediate container into the water basin, wherein the upper level (N1) is set in the water container through a compressed air source connected to a closed equalization container and the lower level (N2) is set by turning this source off, may be operated very rapidly and economically; commercially-available level switches actuate a compressor which is used as the compressed air source. As soon as the compressor is switched off, the water flows back into the intermediate container; it then implements the level N3 there again.

The cleaning method, wherein the processed workpieces are guided through a cleaning station as the frame is moved out and cleaned and/or dried using water and/or compressed air, is very economical and environmentally friendly. The water washed and/or blown off flows back into the water basin in this case; the solid particles possibly used do as well, so that both components are recirculated.

Stacked frames, possibly reaching up into the supporting frame, may ensure automated operation. It is only important that the height for introducing and removing the frames is approached reproducibly. The frames prepared for processing workpieces may be stacked one under another or one on top of another with their height adjustable. The loading and unloading of the workpieces per se may be performed using conventional means.

In a variation which is not shown, the individual frames are stacked one on top of another, rising above the machine tool, so that the lowermost frame is introduced into the water basin in each case. The finished processed parts are moved away on the same horizontal plane via the loading station in this case, before the next frame is lowered to the same height and introduced into the water basin.

In the following, the present invention is discussed in detail for exemplary purposes on the basis of a machine tool implemented for either abrasive or pure water jet cutting.

DESCRIPTION OF THE FIGURES

In all of the figures, functionally identical parts are provided with identical reference numbers.

DETAILED DESCRIPTION OF THE INVENTION

Figure 1:
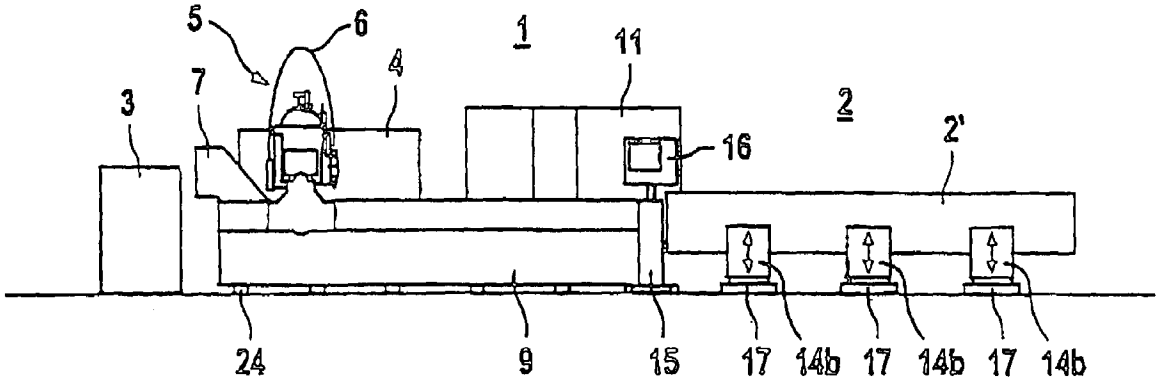
FIG. 1 shows the complete machine tool, viewed from its operating side, together with an assigned loading station.

In FIG. 1, a cutting facility for either pure water jet cutting or water-abrasive jet cutting is identified with 1. A loading station 2, also called a shuttle table, is placed adjoining and aligned thereto. A cooling device 3, having insulated pipelines (not shown) is used for cooling the sensitive components of the facility 1, particularly the high-pressure pump facility 4 placed next to it. An operating pressure of up to 4000 bar exists in the thin, metallic high-pressure lines 6. These lines 6 are guided to a cutting bridge 5, cf. FIG. 2, and supply cutting heads S1 and S2 with pressurized water there.

The cutting bridge 5 is constructed in a known way over a water basin 9, and is linearly movable over its length. Electronics cabinets 11, which also contain the computer for the CNC controller in addition to the power supply for all control and auxiliary devices, are located behind the water basin 9. An operating station 16, which is mounted on a stand 15 whose height is adjustable and also has a display screen, is positioned in front of the basin 9.

Furthermore, a base frame 2' of the loading station 2 and lifting devices 14*b* and a discharge throat 7 for used solid particles are visible in FIG. 1.

Figure 2:
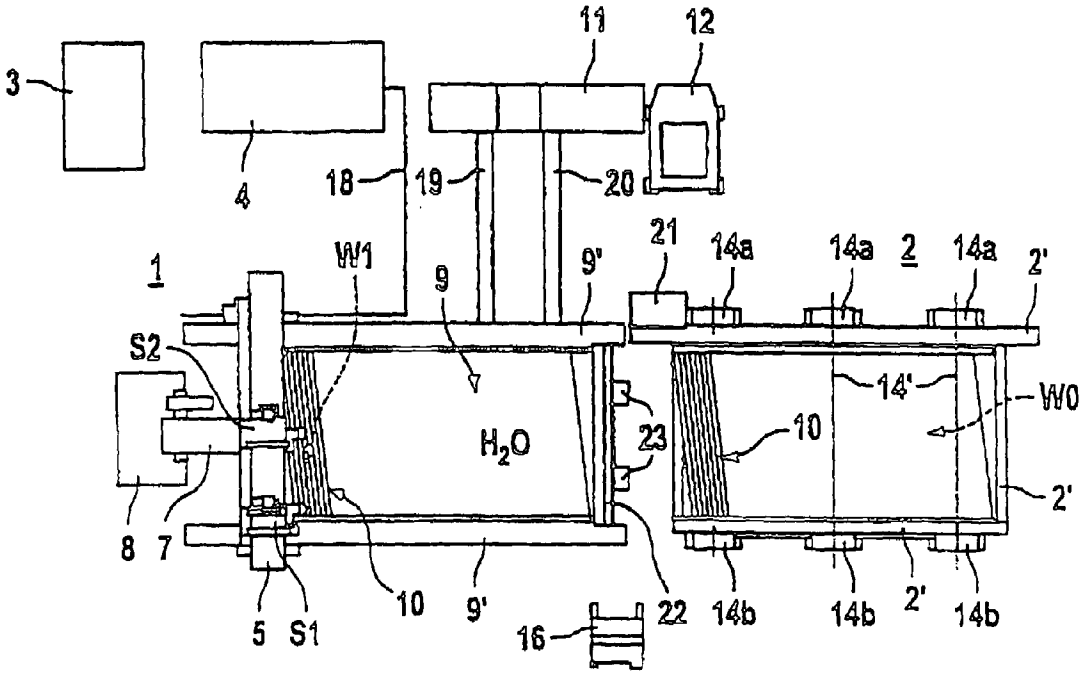
FIG. 2 shows the machine shown in FIG. 1, seen from above.

The top view in FIG. 2 additionally shows a mobile sand bunker 12, which contains the clean solid particles necessary for the abrasive cutting. A fixed high-pressure line is identified with 18 and electrical channels are identified with 19 and 20.

A catch container 8 for the slurry containing the solid particles, which is charged via a drag conveyor known per se and via the discharge throat 7, is aligned on the face and to the central axis of the water basin 9. The water basin itself is enclosed by a base frame 9'. A support 10 for workpieces W1 is located above the water surface—identified with $H_2O$.

On the face of the water basin 9 diametrically opposing the loading station 2, a foldable side wall 22 having associated lift-pivot cylinders is indicated.

The loading station 2 has, adjoining the cutting facility 1, a chain drive 21 (drive motor having chain wheels). The supports 10 equal to the cutting facility 1 extend—as therein—over the entire surface and are implemented in the form of grating slabs, also known per se. Workpieces W0 intended for processing are laid on these grating slabs and are also clamped, depending on the object.

Three lifting devices 14*a* and/or 14*b*, which are in turn coupled to one another by three mechanical connections 14', are attached diametrically opposing the actual shuttle table of the loading station 2. This is symbolized by a dot-dash line. In addition, the three cylinders of the lifting devices 14*a* and 14*b* are hydraulically coupled, so that the frames of the supports 10 may have their heights adjusted absolutely parallel.

Figure 3:
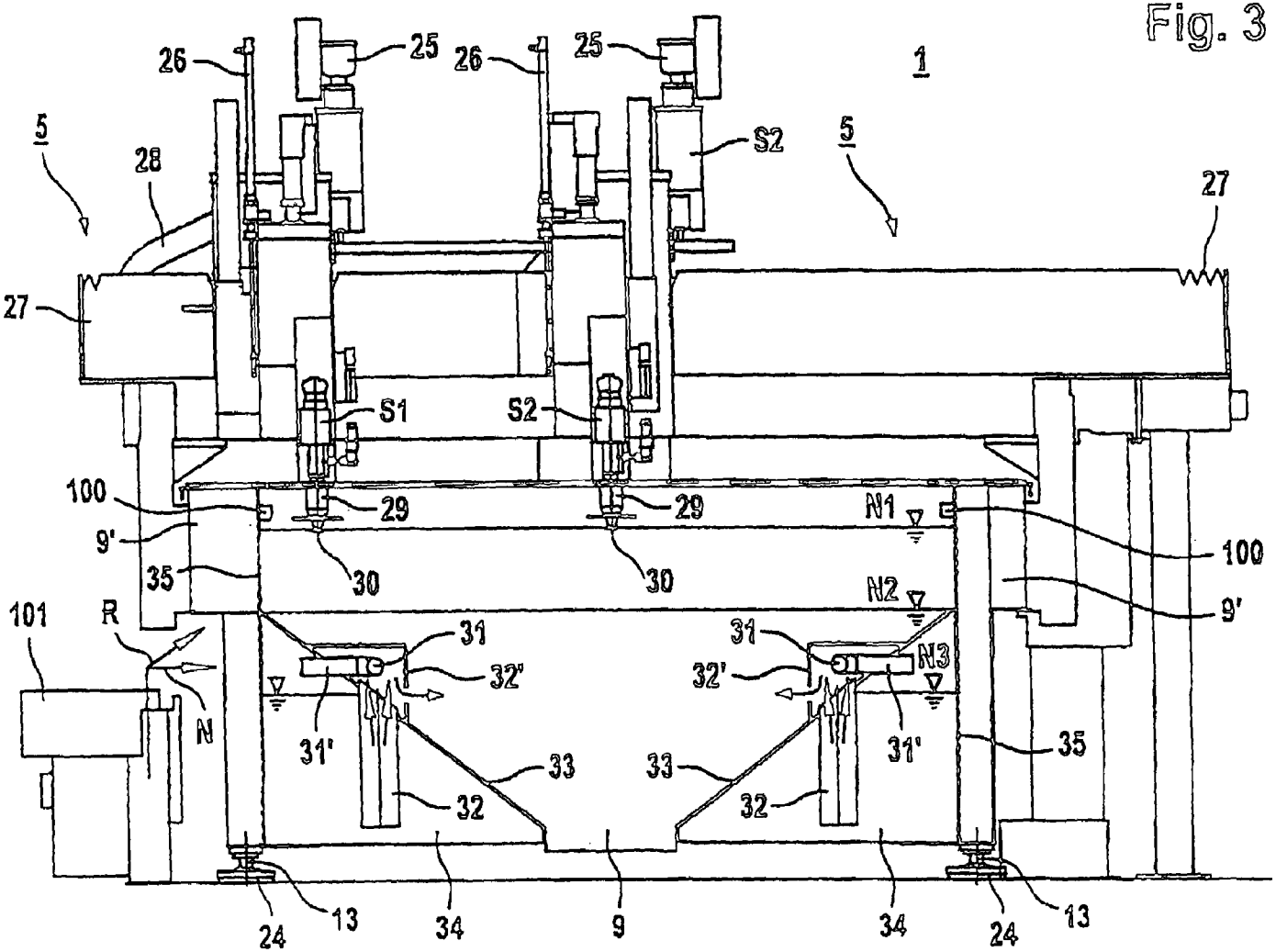
FIG. 3 shows a partial section through the water basin and the cutting devices of the machine shown in FIG. 1 and FIG. 2 positioned above it.

FIG. 3 shows the inside of the water basin 9 of the machine 1 having its associated equalizing basin 34, which is separated therefrom via walls 33; three water levels N1 through N3 are shown.

The cutting bridge 5 having its known components such as equalizing cylinders 26, individually controllable cutting heads S1 and S2, a line duct 28 for power and signal supply of the cutting bridge 5, and an expansion bellows 27, also typical, are mounted on the base frame 9'. The equalizing cylinders 26 are used, as is also known, for weight equalization in the Z direction.

Slide rails 100 are indicated in the water basin 9, above its highest level N1, attached around the edge to diametrically opposing fixed side walls 35. Cutting nozzles 29 having well-known height scanners 30, illustrated here in the operating position, are also shown.

A pressurized air source, a commercially available side channel compressor 101 (Ernst Häusermann & Co. AG, CH-8010 Zurich: two-stage side channel compressor of the type DORA SAP 300) is placed on the bottom left side, beside the facility 1. Outgoing feed lines N and R are indicated by arrows. Line N is guided to a connection 31 of an air supply line 31'. The compressed air exiting from the supply line 31' increases the air cushion existing in the equalizing container, through which the water present here flows out via ascending pipes 32 in the direction of the arrow via the cover 32' into the water basin 9. The water level may thus be set at the preselected height N1 in a simple way—with throttle valves interposed. The cover 32' is used as a slurry protection and only has lower slots for the water to flow through; see arrows.

In order to lower the water to the level N2, the pressure source 101 is switched off, through which the water flows back and finally the level N2 or N3 results. In this time, the pressure source may be switched over and guided via the second line R to a cleaning station to be discussed later.

Figures 4, 4A, 4B:
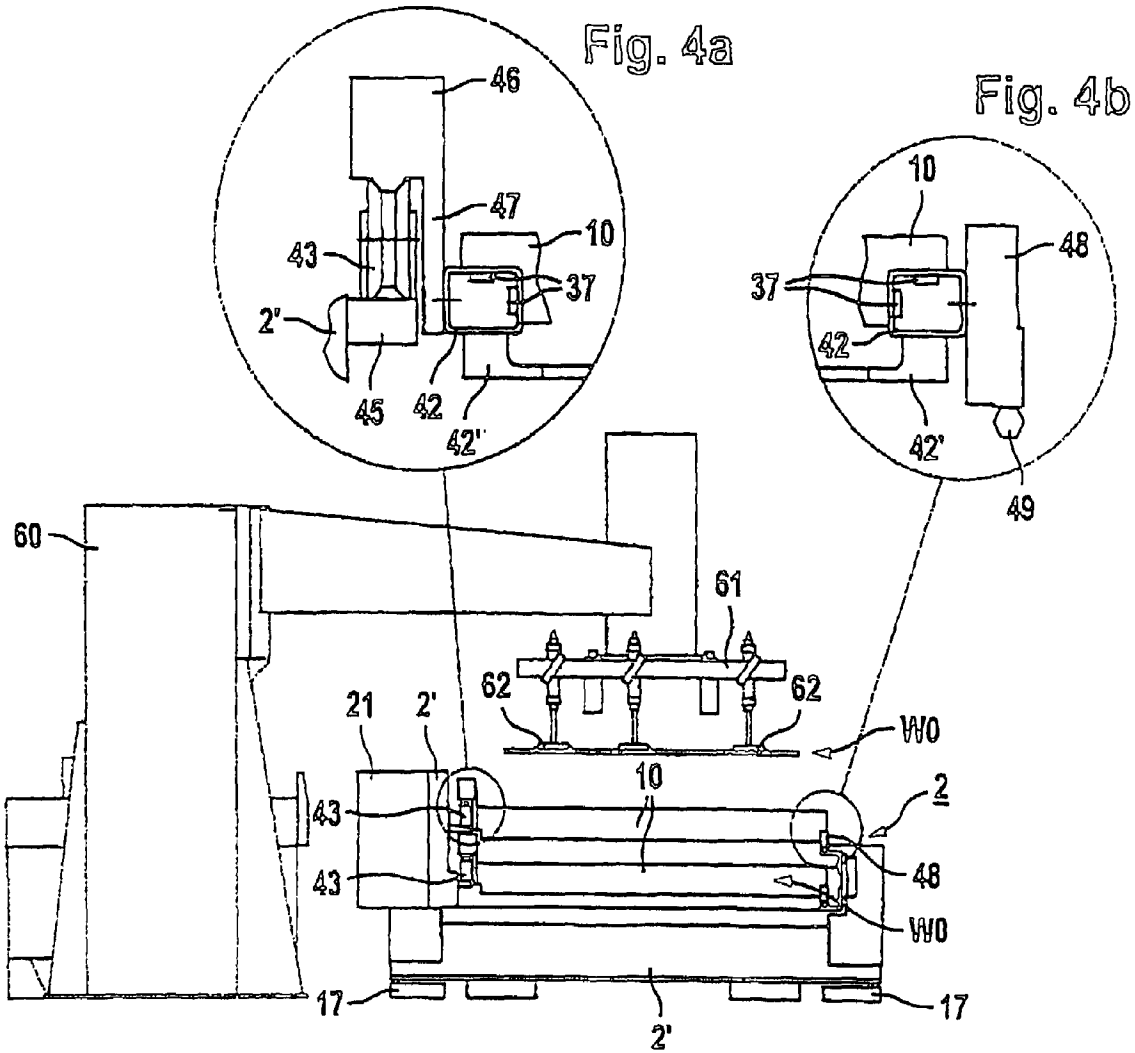
FIG. 4 shows the loading station shown in FIG. 1 and FIG. 2 having an additional pivotable pneumatic lifting device for loading metal sheets.
FIG. 4*a* shows a first lateral guide having rollers; an enlarged illustration from FIG. 4.
FIG. 4*b* shows a second lateral guide; enlarged from FIG. 4.
Figure 5:
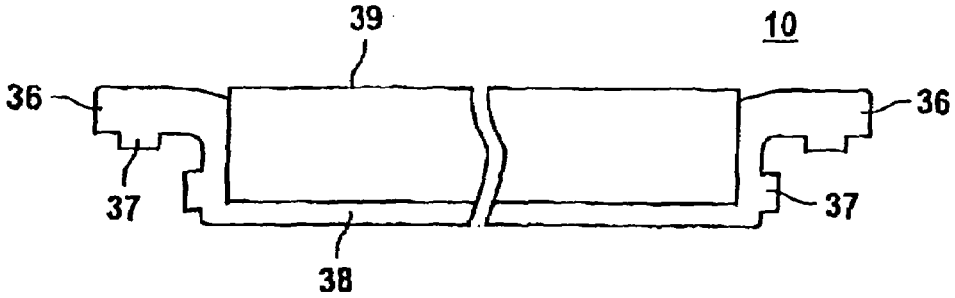
FIG. 5 shows a support for workpieces in the form of a grating slab.

FIG. 4 shows the loading station 2 in the center, which supplies the workpieces W0 to be processed by a pivot lift or 60 having a gripper 61, via vacuum bell jars 62. The chain drive 21, the base frame 2', guide rollers 43, and side jaws 48 are visible here. Floor plates 17, which allow the operating height to be equalized to the machine tool 1, are also visible.

It may be seen from FIG. 4*a* that the rollers 43 are mounted on the base frame 2 via a roller support 45 so they are rotatable. A profiled slide rail 46 engages on the rollers 43, which carries a frame 42, 42' via first side jaws 47, in which grating slabs are suspended that are used as the supports 10.

On the diametrically opposing side, see FIG. 4*b*, the rollers are dispensed with, the frame 42, 42' is attached here to second side jaws 48 and slides on profile 49.

The support 10, the grating slabs, includes a stirrup frame 38 having suspension wings 36 and projecting cams 37. The actual support is a reinforced rubber lip 39 which is inserted replaceably into the frame 38.

Figure 6:
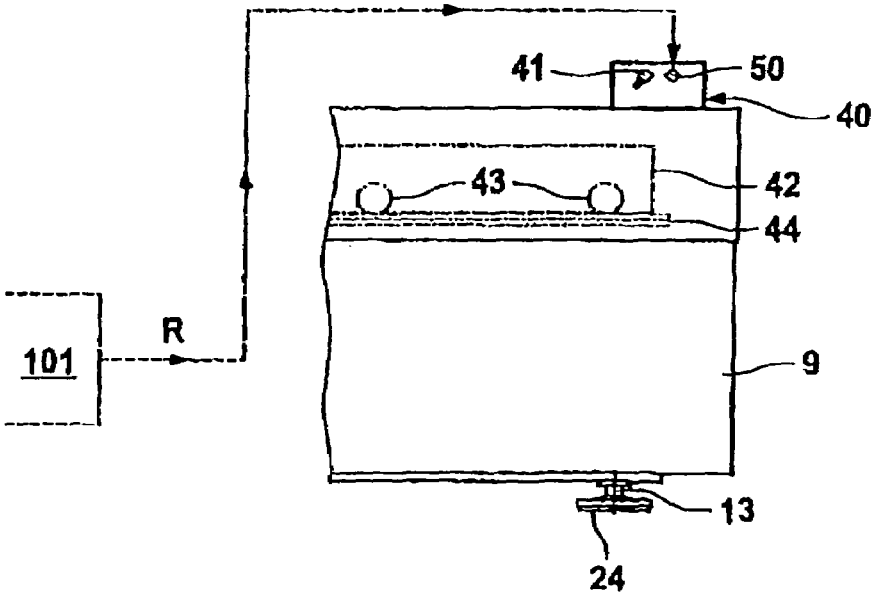
FIG. 6 shows the end of the water basin provided for loading and unloading the machine having frames inserted and a cleaning station.

FIG. 6 shows the end region of the water basin 9 in simplified form: one may again see rollers 43 and the frames 42 running thereon here, as well as lower guide rails 44. A cleaning station 40, which contains water nozzles 41 and air nozzles 50, is installed above the water basin 9 at the end.

The water nozzles 41 are connected to the fresh water; they are actuated as the frame 42 is moved out and wash off abrasive material and/or material removed from the workpieces from the finished parts.

The air nozzles 50 are fed by the pressure source 101 and additionally dry off the parts. The water flowing off of the parts falls back into the water basin 9.

Figure 7A:
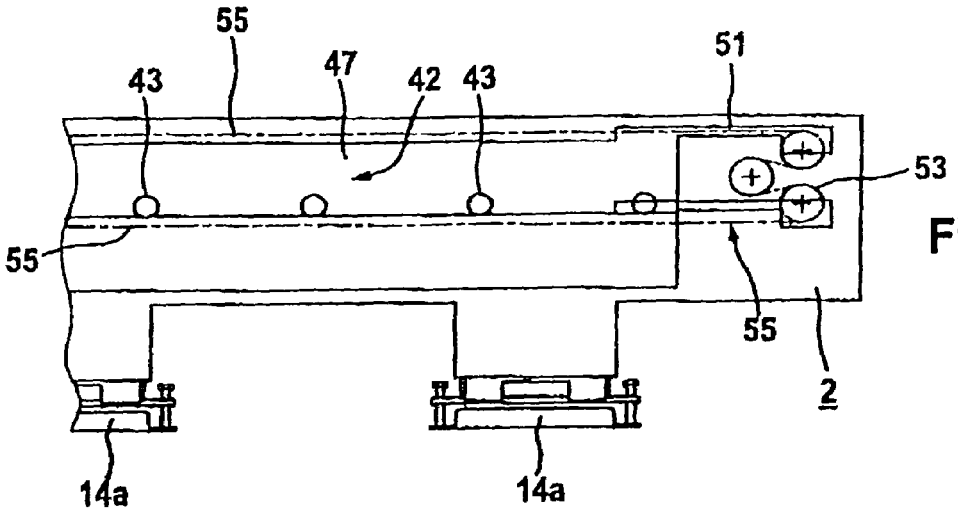
FIG. 7*a* shows a partial section through the loading station in FIG. 1.
Figure 7B:
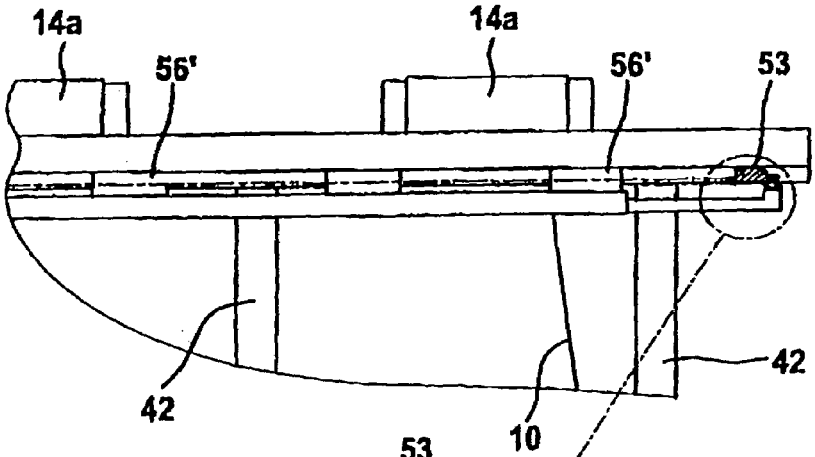
FIG. 7*b* shows details of the guide and the linear drive of the frames in the loading station in FIG. 7*a* in a top view.
Figure 7C:
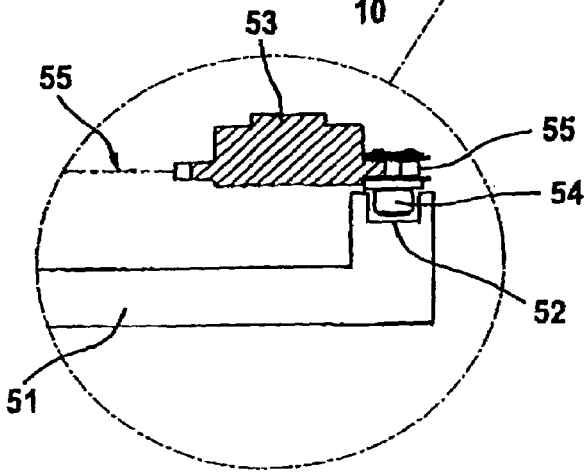
FIG. 7*c* shows an enlarged illustration from FIG. 7*b* with coupling of the frame to the linear drive.

FIGS. 7*a* through 7*c* show details on moving the frame 42 in and out with its supports. The first side jaws 47 having rollers 43 and an angled pushrod 51, which engages on a tappet 54 via a recess 52 as shown in FIGS. 7*b* and 7*c*, are visible here. This tappet 54 is placed on a chain link 55, which in turn runs over chain wheels 53.

The chain links 55 form an endless chain, over which drive 21 is guided, cf. FIG. 2. The chain drive 21 moves the frame 42 with its supports into the water basin 9, FIG. 2, and may move it back out again, into the position shown in FIGS. 7*a* and 7*b*, by switching over the rotational direction of the drive 21.

Figure 8:
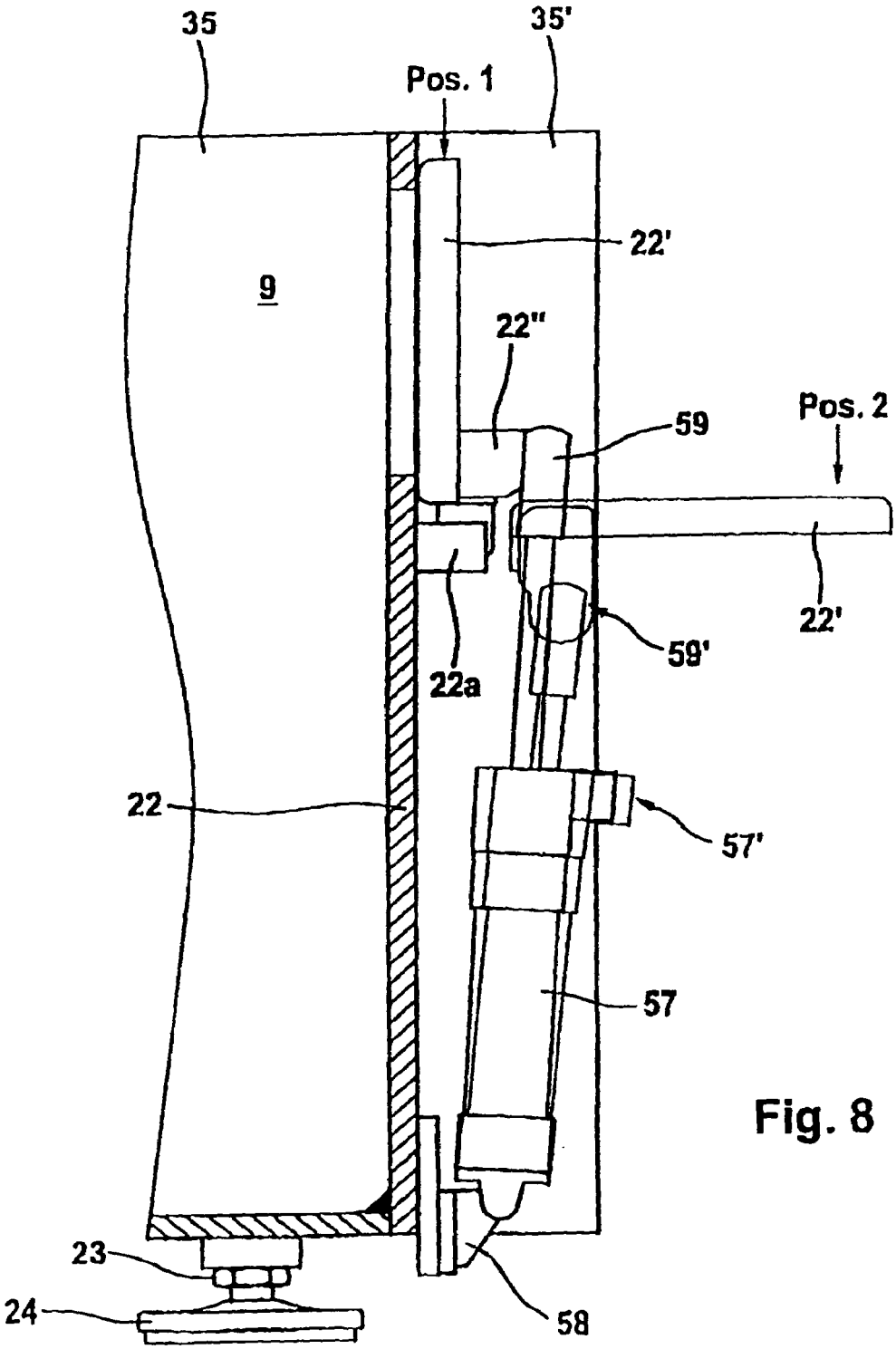
FIG. 8 shows a sectional illustration through the face of the water basin in FIG. 1 having its foldable side wall with its lift-pivot cylinder.

The illustration in FIG. 8 shows the closing mechanism of the foldable side wall 22 and is constructed like a "bulkhead". The water basin 9 is terminated on its face by the side wall 22 (Pos. 1), which has a bearing 22*a* in its upper region and allows the part 22'—a flap—to tilt by 90°. A hydraulic cylinder 57, which is held at its end on a lower joint 58 so it is rotatable and engages using its pushrod (via a joint pin) on the flap 22' at an angle 22", is used as a drive.

The opened position of the flap 22' is shown thin and marked as Pos. 2; the corresponding positions of the pushrods are identified with 59' and those of the hydraulic cylinder with 57'.

For reasons of illustration, showing the necessary sealing elements was dispensed with; the very simply constructed level setting having adjustment screws 13 and an adjustable support 24 may be seen in the lower region of the water basin.

The object of the present invention is, of course, also suitable for multiaxis and other processing procedures.

List of Reference Numbers

1 water jet cutting facility
2 loading station/shuttle table
2' frame for 2
3 cooling device
4 high-pressure pump facility
5 cutting bridge
6 high-pressure lines
7 discharge throat (for drag conveyor)
8 catch container for slurry

9 water basin
9' base frame of 9
10 supports/grating slabs
11 electronics cabinets/CNC controller
12 sand bunker
13 adjusting screws/hexagon
14*a*,14*b* lifting devices/hydraulic lifting cylinder
14' mechanical coupling between 14*a* und 14*b*
15 stands (adjustable height)
16 operating station having display screen
17 floor plates
18 high-pressure line
19, 20 electrical ducts
21 chain drive
22 "bulkhead"/foldable side wall
22' flap
22" angle on 22'
22*a* bearing of 22
23 lift-pivot cylinder
24 level equalization (adjustable support)
25 dosing container for cutting sand
26 equalization cylinder (weight equalization)
27 expansion bellows
28 electrical line duct
29 cutting nozzles
30 height scanning/linear sensors
31 connection
31' air supply line
32 ascending pipes
32' cover/slurry protection
33 wall/partition wall
34 equalization container
35 fixed side wall of 9
35' cover (lateral)
36 suspension wing of 10
37 cams
38 stirrup frame
39 reinforced rubber lip
40 cleaning station
41 water nozzles
42 frame (for supports 10)
42' frame connection to 42
43 guide rollers
44 guide rails
45 roller support
46 slide rails
47 first side jaw (jet deflection)
48 second side jaw (jet deflection)
49 slide profile
50 air nozzles
51 pushrod (angled)
52 recess
53 chain wheels
54 tappet
55 chain links/chain
56 slide block (slide block/support)
57 hydraulic cylinder (in position 1)
57' hydraulic cylinder (in position 2)
58 joint
59 pushrod with joint pin (in position 1)
59' pushrod (in position 2)
60 pivot lifter/hoist
61 gripper
62 vacuum bell jars
100 slide rails in 9
101 compressed air source/side channel compressor
N air supply level settings water
N1 cutting level
N2 loading and unloading level
N3 level in equalization container 34
R feed line to 40
S1, S2 cutting heads
W0 workpieces (plate/sheet)
W1 processed workpiece (part, cut out)
X,Y,Z movement directions of S1, S2

What is claimed is:

1. A machine tool for processing workpieces using a high-pressure water jet, the workpiece to be processed being mounted on a grate-like or grid-like support over or in a water basin, which is cuboid at least in the upper region, and has at least one water jet exiting from at least one nozzle applied to it, this nozzle being numerically controlled in its position at least in a horizontal plane (X, Y) and the distance between the workpiece and the nozzle being kept at least approximately constant or controlled in the vertical direction (Z) and an equalization container being provided in the region of the water basin, via which the level in the water basin is set, characterized in that at least one side wall on the water basin is designed as partially raisable or foldable and sliding elements, which allow a frame, having workpieces positioned on its workpiece supports, to be moved in and out, are positioned on at least the fixed side walls adjoining this side wall.

2. The machine tool according to claim 1, characterized in that outside the raisable or foldable side wall, mounted in front of the water basin, at least one frame having workpiece supports is provided, whose height position is adjustable via a lifting device and which may be pushed into the water basin via the sliding elements through a horizontal displacement.

3. The machine tool according to claim 1, characterized in that an equalization container, which communicates with the water basin and may have a compressed air source applied to it, is mounted in or below the water basin.

4. A machine tool according to claim 3, characterized in that the compressed air source is a side channel compressor.

5. The machine tool according to claim 1, characterized in that a cleaning station is positioned above the raisable or foldable side wall.

6. The machine tool according to claim 3, characterized in that the cleaning station contains water nozzles and/or compressed air nozzles.

7. The machine tool according to claim 6, characterized in that the compressed air nozzles are connected to the compressed air source connected to the equalization container.

8. The machine tool according to claim 1, characterized in that the frame having the workpiece supports may be pushed into and pulled out of the water basin by a chain drive.

9. The machine tool according to claim 2, characterized in that the frame having the workpiece supports may be pushed into and pulled out of the water basin by a chain drive.

10. A method for operating a machine tool for processing workpieces using a high-pressure water jet, the workpiece to be processed being mounted on a grate-like or grid-like support over or in a water basin, which is cuboid at least in the upper region, and having at least one water jet exiting from at least one nozzle applied to it, this nozzle having its position numerically controlled at least in a horizontal plane (X, Y) and the distance between the workpiece and the nozzle being kept at least approximately constant or controlled in the vertical direction (Z) and an equalization container being provided in the region of the water basin, via which the level in the water basin is set, characterized in that in a first method step the water basin is filled to a lower level, in a second step, with the side flap opened, a frame equipped with workpieces is introduced horizontally, in a third step the flap is closed tight and the water is let into the water basin until a higher level results, in a fourth step the water jet processing is performed, in a fifth step the water is let out to the lower level and subsequently the flap is opened until it is in the horizontal setting, in a sixth step the frame is moved horizontally out of the water basin, and in a seventh step a further frame equipped with workpieces is introduced horizontally into the water basin and the flap is closed tight again.

11. The method for operating a machine tool according to claim 10, characterized in that the upper level is set in the water container through a compressed air source connected to a closed equalization container and the lower level is set by turning this source off.

12. The method for operating a machine tool according to claim 10, characterized in that the processed workpieces are guided through a cleaning station as the frame is moved out and cleaned and/or dried using water and/or compressed air.

13. The method for operating a machine tool according to claim 10, characterized in that the frames prepared for processing workpieces are stacked one under another or one on top of another with their height adjustable.

* * * * *

UNITED STATES PATENT AND TRADEMARK OFFICE

CERTIFICATE OF CORRECTION

PATENT NO. : 7,121,918 B2
APPLICATION NO. : 10/830417
DATED : October 17, 2006
INVENTOR(S) : Daniel Marti et al.

It is certified that error appears in the above-identified patent and that said Letters Patent is hereby corrected as shown below:

Column 2, lines 53-54, the phrase "the workpiece in the Z direction or are also CNC-controlled." should be deleted.

Signed and Sealed this

Fourth Day of September, 2007

JON W. DUDAS
*Director of the United States Patent and Trademark Office*